US010215509B2

(12) United States Patent
Somhorst et al.

(10) Patent No.: US 10,215,509 B2
(45) Date of Patent: Feb. 26, 2019

(54) COINED HEADER FOR HEAT EXCHANGER

(71) Applicant: Hanon Systems, Daejeon (KR)

(72) Inventors: Leo Somhorst, Chislehurst (GB); James Grainger, London (GB); David Bowring, Maldon (GB); Petr Kolder, Rožnov pod Radhoštěm (CZ)

(73) Assignee: HANON SYSTEMS, Daejeon (KR)

( * ) Notice: Subject to any disclaimer, the term of this patent is extended or adjusted under 35 U.S.C. 154(b) by 214 days.

(21) Appl. No.: 15/187,831

(22) Filed: Jun. 21, 2016

(65) Prior Publication Data

US 2017/0363372 A1 Dec. 21, 2017

(51) Int. Cl.

| | |
|---|---|
| ***F28D 1/00*** | (2006.01) |
| ***F28F 9/02*** | (2006.01) |
| ***F28F 9/14*** | (2006.01) |
| ***F28D 21/00*** | (2006.01) |

(52) U.S. Cl.

CPC ..... *F28F 9/14* (2013.01); *F28D 1/00* (2013.01); *F28F 9/0226* (2013.01); *F28D 2021/008* (2013.01); *F28F 2230/00* (2013.01)

(58) Field of Classification Search

CPC .... F28F 9/14; F28F 9/0226; F28F 9/06; F28F 9/08; F28F 9/12; F28F 2225/02; F28F 2225/08; F28F 2230/00; F28F 2255/08; F28F 2255/02; F28F 2275/08; F28F 2275/085; F28F 2275/14; F28F 2280/06; F28F 2280/105; B21D 53/02; B23P 15/26

See application file for complete search history.

(56) References Cited

U.S. PATENT DOCUMENTS

| | | | | |
|---|---|---|---|---|
| 4,461,348 A * | 7/1984 | Toge | ..... | F28F 9/0226 165/149 |
| 4,649,628 A * | 3/1987 | Allemandou | ..... | F28F 9/0226 165/148 |
| 4,651,815 A * | 3/1987 | Logic | ..... | F28F 9/0226 165/148 |
| 5,944,095 A * | 8/1999 | Fukuoka | ..... | F28F 9/0224 165/149 |
| 5,947,196 A | 9/1999 | Halm et al. | | |

(Continued)

FOREIGN PATENT DOCUMENTS

| | | | | |
|---|---|---|---|---|
| DE | 2703528 A1 * | 8/1978 | ..... | F28F 9/0226 |
| DE | 102013217689 A1 * | 3/2015 | ..... | F28F 9/0226 |
| FR | 2499234 A1 * | 8/1982 | ..... | F28F 9/0226 |

(Continued)

OTHER PUBLICATIONS

AZoM—Coining Metallurgical Processes.pdf.*

(Continued)

*Primary Examiner* — Orlando E Aviles
*Assistant Examiner* — Jose O Class-Quinones
(74) *Attorney, Agent, or Firm* — Shumaker, Loop & Kendrick, LLP; James D. Miller

(57) ABSTRACT

A header for a heat exchanger includes a header frame defining an opening and including a base portion circumscribing a perimeter thereof. A mounting tab extends from the base portion. The mounting tab is configured to bend inwardly with respect to the header frame. A deformation featured is formed on one of an inner surface and an outer surface of the header frame and is configured to facilitate bending of the mounting tab.

19 Claims, 6 Drawing Sheets

(56) References Cited

U.S. PATENT DOCUMENTS

| | | | | |
|---|---|---|---|---|
| 2008/0308263 | A1 | 12/2008 | Kolb | |
| 2015/0129188 | A1 * | 5/2015 | Frankiewicz | B23P 15/26 165/173 |

FOREIGN PATENT DOCUMENTS

| | | | | |
|---|---|---|---|---|
| FR | 2614408 | A1 * | 10/1988 | F28F 9/0226 |
| JP | 10160383 | A * | 6/1998 | F28F 9/0224 |
| WO | 2014173909 | A1 | 10/2014 | |

OTHER PUBLICATIONS

DE 2703528 A1—English Machine Translation.pdf.*
FR 2499234 A1—English Machine Translation.pdf.*
JP 10160383 A—English Machine Translation.pdf.*
DE 102013217689 A1—English Machine Translation.pdf.*
FR 2614408 A1—English Machine Translation.pdf.*

* cited by examiner

COINED HEADER FOR HEAT EXCHANGER

FIELD OF THE INVENTION

The invention relates to a heat exchanger for a motor vehicle, and more particularly, to a header for coupling a fluid reservoir to a heat exchanger.

BACKGROUND

Heat exchangers are generally formed of a core configured to facilitate an exchange of thermal energy with a fluid passing therethrough. A header is disposed on at least one end of the core, and provides an interface between the core and a fluid reservoir, such as a tank or manifold. One common type of header is known as a recessed header, wherein a portion of the header is recessed to receive a portion of the fluid reservoir therein.

In modern heat exchangers, an integrated means for coupling the fluid reservoir to the header is desirable, as it allows the heat exchanger to be assembled without using independent fastening means, such as bolts and clips. By using an integrated means for coupling the headers and fluid reservoirs, manufacturing costs can be substantially reduced by minimizing assembly time and eliminating unnecessary components.

However, in recent years, increased performance requirements for heat exchangers have caused existing configurations of integrated coupling means to become insufficient. For example, modern heat exchangers operate at increased internal pressures. During operation at the increased internal pressures, the interface between the header and the fluid reservoir may warp or fracture as a result of pressure induced stresses, causing a failure of the heat exchanger.

In a common heat exchanger configuration, a fluid reservoir is coupled to a header by inserting a portion of the fluid reservoir into the header, and subsequently securing the fluid reservoir by a crimping process or deforming a plurality of tabs of the header over the inserted portion of the fluid reservoir. However, this configuration is prone to failure under the increased pressure conditions of modern heat exchangers. For example, as the pressure within the fluid reservoir increases, the fluid reservoir is biased apart from the header, and the inserted portion of the fluid reservoir applies a bending moment to the tabs of the header. The bending moment forces the tabs of the header outward, allowing the fluid reservoir to separate from the header. Further, deforming the tabs of the header creates residual stress concentrations in the header. Upon application of the increased pressures, the areas of the residual stress concentrations are prone to failure.

Additionally, modern heat exchangers are commonly integrated into rigid components of the vehicle. By rigidly mounting the heat exchanger within the vehicle, the heat exchanger is more susceptible to harmful vehicle vibrations. Accordingly, increased vibration of the heat exchanger further increases stresses in the interface between the header and the fluid reservoir.

In order to solve the problem of increased vibration, a strength, stiffness, and durability of the header is increased. By increasing the strength, stiffness, and durability of the header, an increased bending force is required to crimp or otherwise deform the plurality of tabs of the header over the fluid reservoir. The increased force causes the header to be more susceptible to distortion and deformations due to the residual stress concentrations therefrom. Additionally, some heat exchangers include heat exchanger tubes received by the header. The tubes minimize distortion of the header. However, other types of heat exchangers have headers that do not receive tubes, such as water-cooled charge air coolers, for example. The increased force applied to headers that do not receive the tubes escalates susceptibility of distortion to such headers.

Accordingly, there exists a need in the art for an improved means of coupling a fluid reservoir to a header of a heat exchanger, wherein the coupling means is integral to the heat exchanger assembly.

SUMMARY OF THE INVENTION

In concordance with the instant disclosure, an improved means of coupling a fluid reservoir to a header of a heat exchanger assembly, wherein the coupling means is integral in the heat exchanger assembly is surprisingly discovered.

In a first embodiment, a header for a heat exchanger includes a header frame defining an opening and including a base portion circumscribing a perimeter thereof. A mounting tab extends from the base portion. The mounting tab is configured to bend inwardly with respect to the header frame. A deformation featured is formed on one of an inner surface and an outer surface of the header frame and is configured to facilitate bending of the mounting tab In another embodiment, a heat exchanger for a motor vehicle is disclosed. The heat exchanger includes a fluid reservoir having a base and a header receiving the base of the fluid reservoir. The header has a mounting tab configured to bend inwardly from a predisposed open position to a closed position. The mounting tab engages the fluid reservoir in the closed position. A deformation feature is formed in the header. The deformation feature minimizes a force required to bend the mounting tab from the predisposed open position to the closed position.

In yet another embodiment, a method of assembling a heat exchanger is disclosed. The method includes the step of providing a fluid reservoir and a header including a mounting tab configured to bend from an open position to a closed position. The method further includes the steps of forming a deformation feature on one of an inner surface and an outer surface of the header to facilitate bending of the mounting tab and inserting a portion of the fluid reservoir into the header. The method further includes the step of bending the mounting tabs inwardly from the open position to the closed position about a pivot point proximate to the deformation feature to engage the fluid reservoir.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
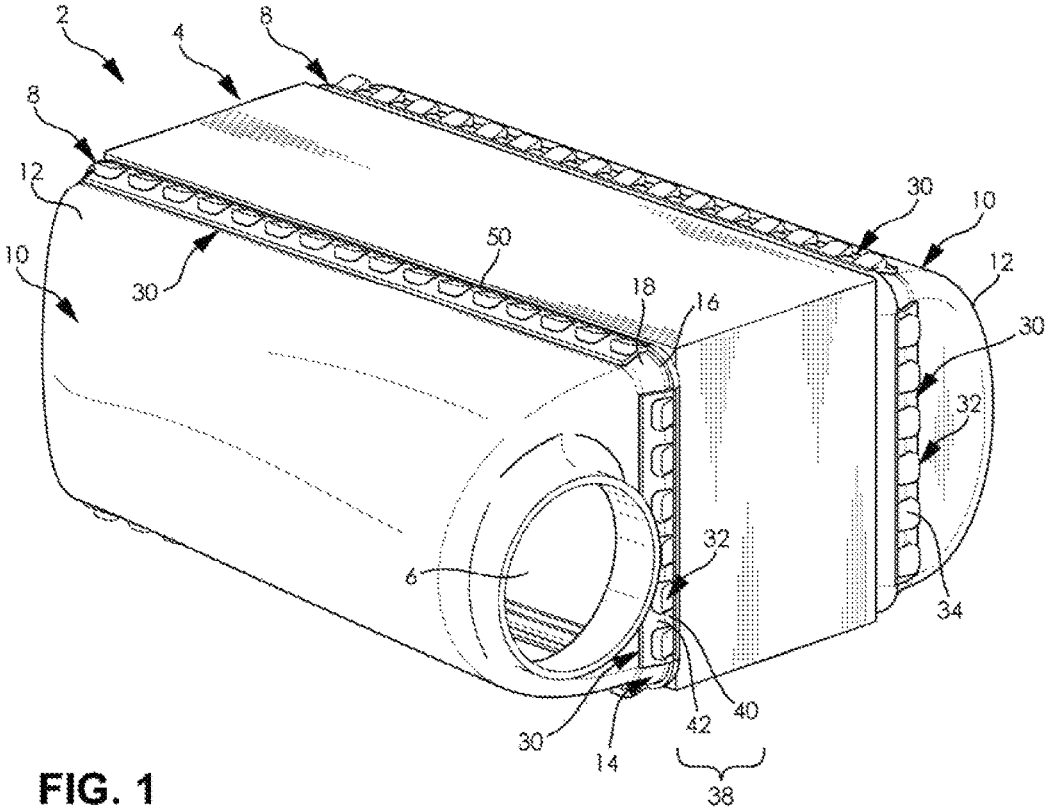
FIG. 1 is a perspective view of a heat exchanger assembly of the instant disclosure.
Figure 2:
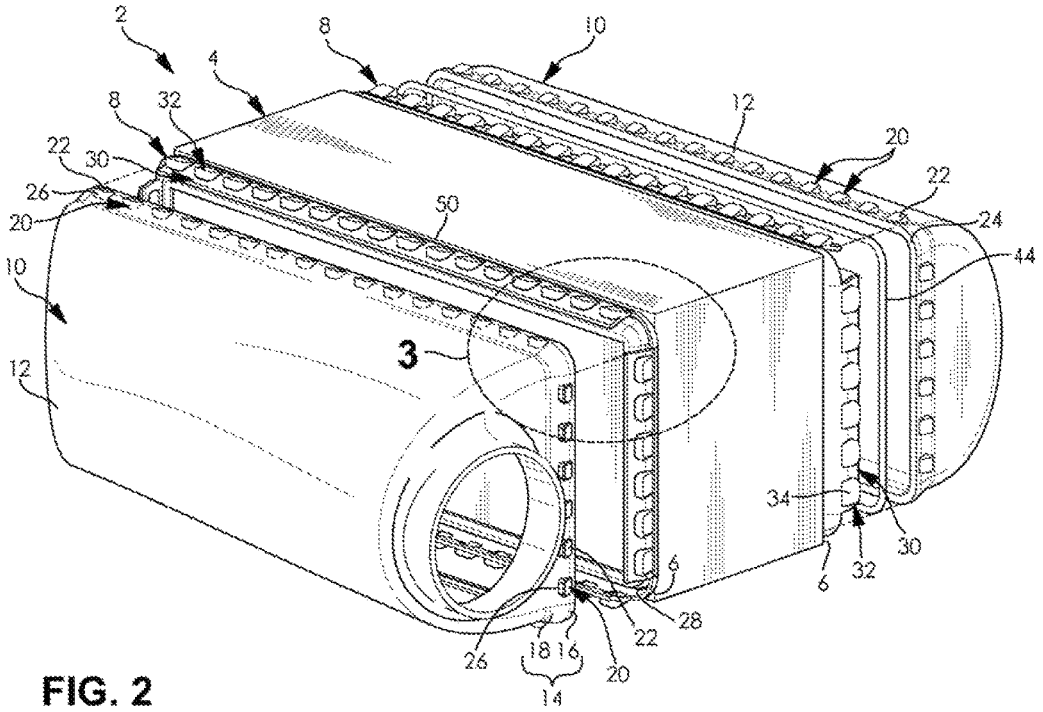
FIG. 2 is a partially exploded perspective view of the assembly of FIG. 1.
Figure 3:
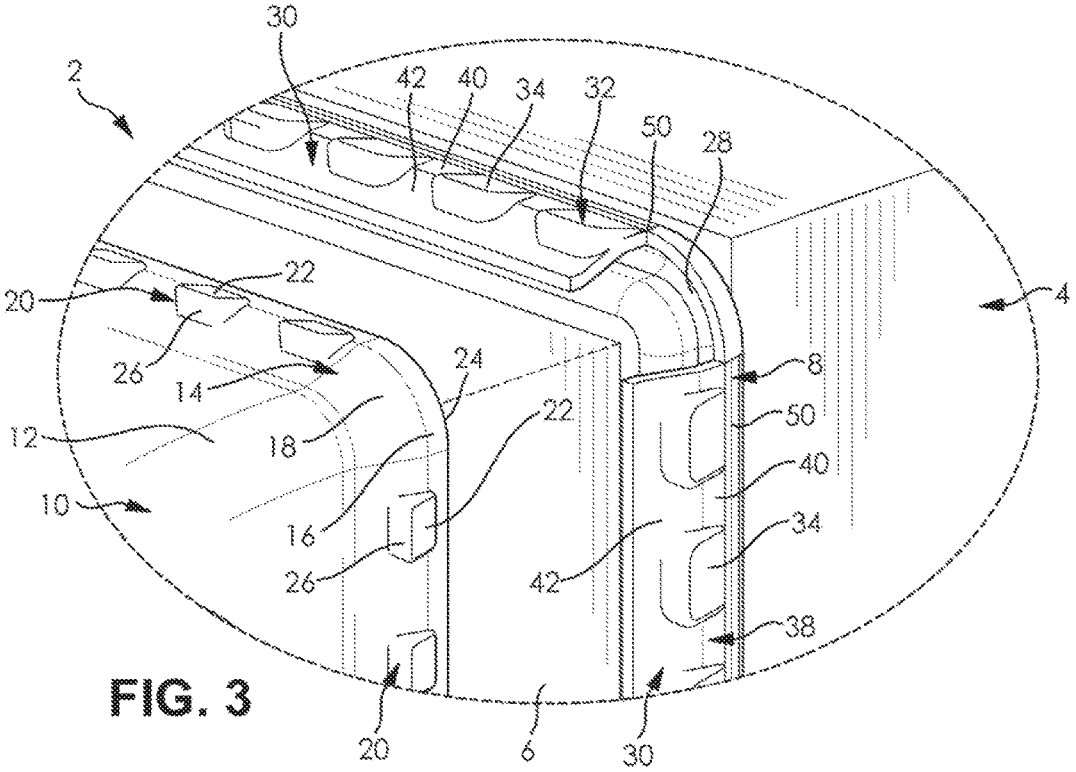
FIG. 3 is an enlarged perspective view of the assembly of FIG. 1, taken at area 3 of FIG. 2.
Figure 4:
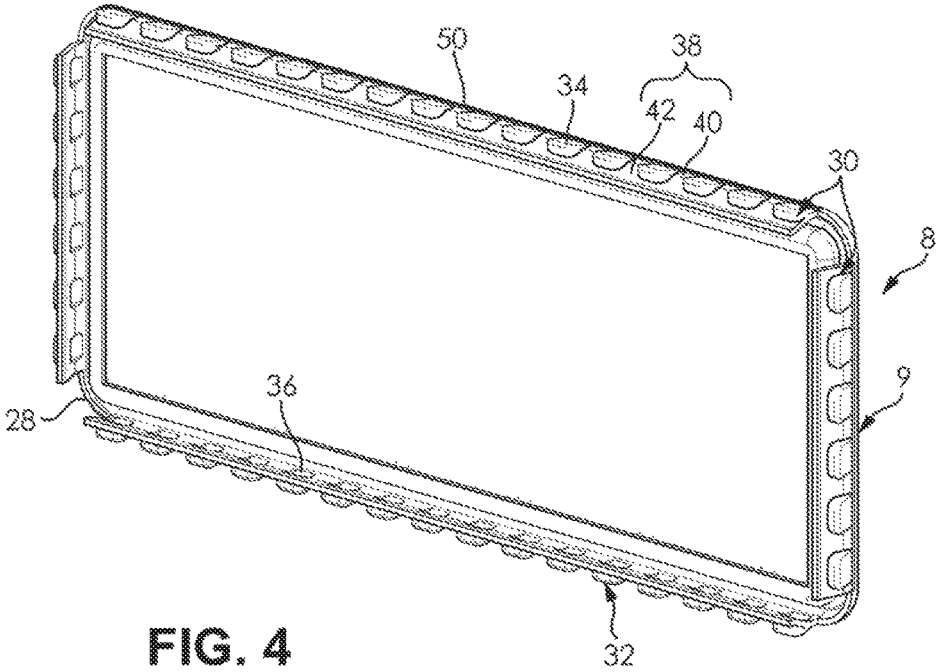
FIG. 4 is a perspective view of a header of the assembly of FIG. 1.
Figure 5:
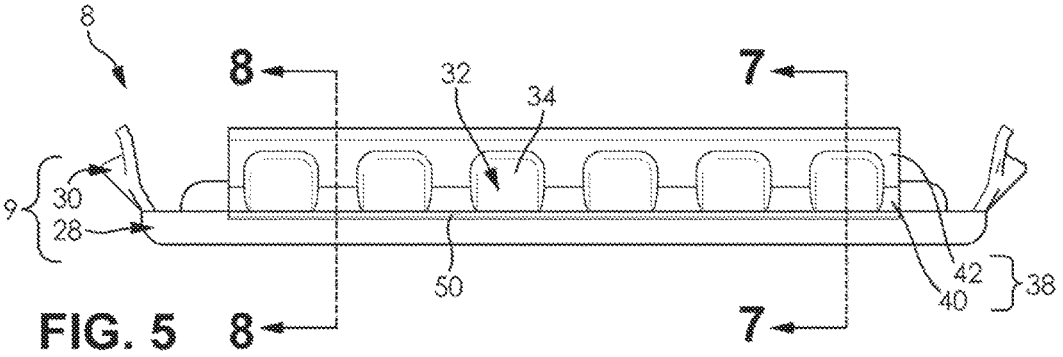
FIG. 5 is an elevational view of the header of FIG. 4, wherein the header is in an open position.
Figure 6:
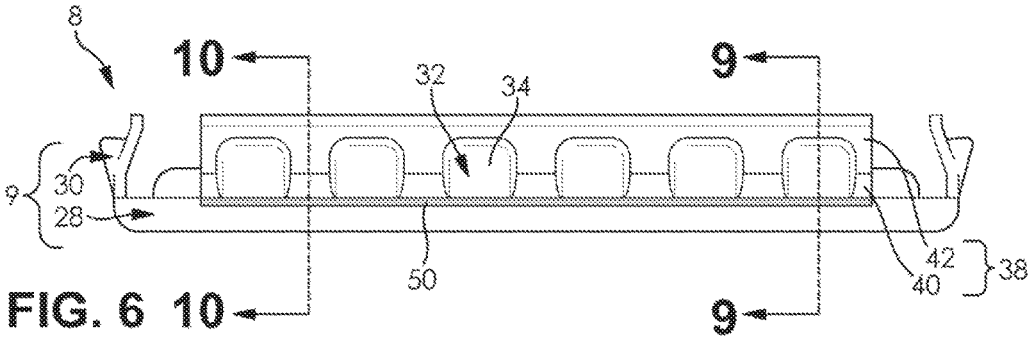
FIG. 6 is an elevational view of the header of FIG. 4, wherein the header is in a closed position.
Figure 7:
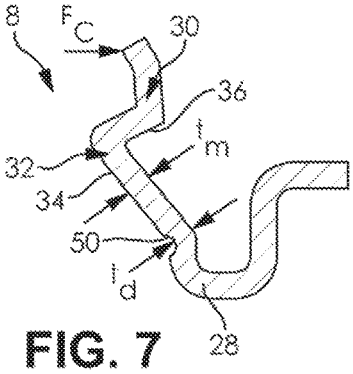
FIG. 7 is a cross-sectional view of the header of FIG. 5, taken along the line 7-7.
Figure 8:
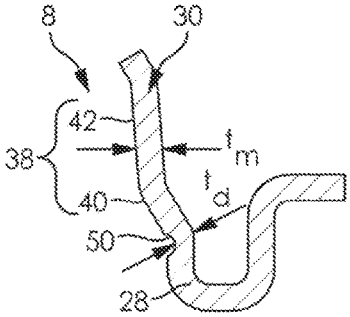
FIG. 8 is a cross-sectional view of the header of FIG. 5, taken along the line 8-8.

FIGS. 1 and 2 show an intake assembly having an integrated heat exchanger 2 according to the instant disclosure. The heat exchanger 2 is formed of a core 4 having a pair of opposing open ends 6. Each of the open ends 6 is configured to provide fluid communication into the heat exchanger 2, wherein fluid enters the heat exchanger 2 through a first one of the open ends 6 and exits the heat exchanger 2 through a second one of the open ends 6. In an alternate embodiment, the heat exchanger 2 may include a single open end 6, wherein fluid enters and exits the heat exchanger 2 through the same open end 6. The heat exchanger 2 further includes a header 8 disposed adjacent each open end 6. The header 8 may be coupled to the heat exchanger 2 using mechanical means, such as welding, crimping, and brazing, for example. Alternatively, the header 8 may be integrally formed with the heat exchanger 2.

A fluid reservoir 10 is removably coupled to each of the headers 8 of the heat exchanger 2. In the illustrated embodiment, each of the headers 8 is similarly formed. Accordingly, any description with respect to the configuration of one of the headers 8 and one of the fluid reservoirs 10 will be understood to similarly apply to the other header 8 and the other fluid reservoir 10. In alternate embodiments, each of the headers 8 may be configured differently than the other.

Referring to FIGS. 1-3 and 11-14, the fluid reservoir 10 includes at least one continuous sidewall 12. A base 14 depends from the sidewall 12 and includes a lip 16 formed adjacent an opening of the fluid reservoir 10, and an intermediate portion 18 connecting the lip 16 and the sidewall 12. In the illustrated embodiment, the lip 16 of the fluid reservoir 10 is outwardly offset from and substantially parallel to a lower portion of the sidewall 12. However, in alternate embodiments, it will be appreciated that the lip 16 may be formed at an oblique angle to the sidewall 12, and that the lip 16 may be aligned with or inwardly offset from the sidewall 12.

A plurality of first coupling features 20 is spaced along the base 14 of the fluid reservoir 10. In the illustrated embodiment, each of the first coupling features 20 is a protrusion extending outward from the base 14 adjacent the lip 16. A distal end 22 of each of the first coupling features 20 tapers outwardly from the fluid reservoir 10, wherein a distance from the distal end 22 to the base 14 increases as a distance from a terminal end 24 of the lip 16 increases. In alternate embodiments, the length of the first coupling feature 20 may be substantially constant.

An engaging surface 26 is formed on each of the first coupling features 20, opposite the terminal end 24 of the lip 16. In one embodiment, each of the engaging surfaces 26 of the first coupling features 20 are coplanar. However, the engaging surfaces 26 of the first coupling features 20 may also be offset from one another.

As shown in FIGS. 11-14, the engaging surfaces 26 are inclined with respect to an axis (A), along which a force is applied to assemble the fluid reservoir 10 to the header 8, wherein a distance from the terminal end 24 to the engaging surface 26 increases as the distance from the base 14 increases. In alternate embodiments, the engaging surface 26 may be formed perpendicular with respect to the axis (A).

Referring to FIGS. 1-10, the header 8 includes a header frame 9 configured to cooperate with a portion of the fluid reservoir 10 when the heat exchanger 2 is assembled. The header frame 9 defines an opening providing fluid communication between the fluid reservoir 10 and the core 4. A base portion 28 circumscribes at least a portion of a perimeter of the header frame 9, and is configured to receive at least a portion of the base 14 of the fluid reservoir 10 therein. In the embodiment illustrated, the base portion 28 is recessed to receive at least a portion of the base 14 of the fluid reservoir 10. However, the base portion 28 can be planer or have other configurations configured to receive the base 14 of the fluid reservoir, if desired. In alternate embodiments, a base portion 28 may be formed in the fluid reservoir 10, wherein a portion of the header 8 is received therein. It will also be appreciated that both or neither of the fluid reservoir 10 and the header 8 may include a base portion.

In the illustrated embodiment, a plurality of mounting tabs 30 extend from the base portion 28 of the header frame 9, wherein a single one of the mounting tab 30 spans each of the sides of the header 8. In alternate embodiments, each of the sides of the header 8 may include a plurality of separately formed mounting tabs 30.

A plurality of second coupling features 32 is spaced along each of the mounting tabs 30. A position of each of the second coupling features 32 corresponds to a position of a respective one of the first coupling features 20 of the fluid reservoir 10, wherein the second coupling features 32 are configured to engage the first coupling features 20 to secure the fluid reservoir 10 to the header 8. In the illustrated embodiment, each of the second coupling features 32 is an enclosed cavity configured to receive at least a portion of the respective of one of the first coupling features 20. The cavity is defined by a sidewall and an end wall 34.

The sidewall of the cavity defines a receiving surface 36 of the second coupling feature 32, which is configured to cooperate with the engaging surface 26 of the first coupling feature 20. In the illustrated embodiment, the receiving surface 36 is formed opposite the base portion 28. As shown in FIGS. 11-14, the receiving surface 36 may be inclined with respect to the base portion 28, wherein a distance from the base portion 28 to the receiving surface 36 increases as a distance from the axis (A) increases. In an alternate embodiment, the receiving surface 36 may be formed substantially parallel to the base portion 28, wherein the receiving surface 36 is perpendicular to the axis (A).

In the illustrated embodiment, a depth of the second coupling features 32 tapers outwardly from the header 8 with respect to the axis (A), wherein a distance between the end wall 34 and the axis (A) increases as a distance from the base portion 28 increases. In alternate embodiments, the depth of the second coupling features 32 remains constant with respect to the distance from the base portion 28.

A plurality of reinforcement features 38 is formed in each of the mounting tabs 30, intermediate each of the plurality of the second coupling features 32. The reinforcement features 38 are configured to militate against a deflection of the receiving surface 36 of the second coupling features 32 when the compressive force is applied along the axis (A). The reinforcement features 38 are formed of a sidewall 40 extending from the base portion 28, and an inwardly formed shoulder 42 extending from the sidewall 40, wherein an inner profile of the mounting tabs 30 is configured to substantially correspond to an outer profile of the base 14 of the fluid reservoir 10. In alternative embodiments, the reinforcement features 38, the first coupling features 20, and the second coupling features 32 can be structurally configured as any type of interlocking features as desired. For example, the shapes of the coupling features 20, 32 can have alternate cross-sectional shapes instead of substantially rectangular, as illustrated, such as substantially circular, substantially ovular, and substantially triangular. Additionally, the reinforcement features 38 can include other reinforcement types features such as additional coupling features, rivets, protrusions, brackets, varying cross-sectional shapes or other features configured to militate against deflection of the receiving surface 36 of the second coupling features 32.

The header 8 includes deformation features 50 formed therein. The deformation features 50 are configured to cause plastic deformation of the header 8 to facilitate flexibility and bending during coupling of the header 8 to the fluid reservoir 10. Plastic deformation induces plastic flow on a localized portion of the header 8 where the deformation features 50 are formed. For example, each of the deformation features 50 is a coined deformation feature formed by a coining process, a stamping process, a swaging process, or similar processes, as desired.

Referring to the exemplary embodiments of FIGS. 4-10, each of the deformation features 50 is a continuous elongate indentation formed in an outer surface of the header 8 along a length of each of the mounting tabs 30. However, in other embodiments, the deformation features 50 can be formed on an inner surface of the header 8 and in the mounting tabs 30 at any position thereof to facilitate a bending of the mounting tabs 30. It is understood, each of the deformation features 50 can be a plurality of perforations, a plurality of slots, a plurality of indentations, or other surface features configured to aid in assembly of the header 8 to the fluid reservoir 10, as desired. A thickness $t_d$ of the header 8 at the deformation features 50 is less than a thickness $t_m$ of the mounting tabs 30. As shown in FIGS. 7-10, the deformation features 50 have an arcuate cross-sectional profile. However, the deformation features 50 can have other cross-sectional profiles as desired such as triangular, rectangular, or serpentine for example.

Figure 9:
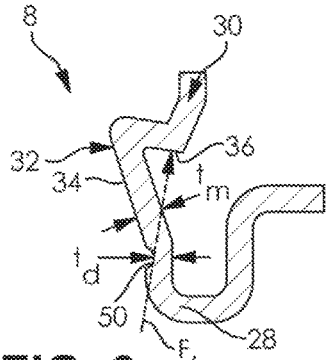
FIG. 9 is a cross-sectional view of the header of FIG. 6, taken along the line 9-9.
Figure 10:
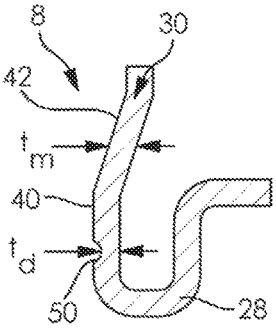
FIG. 10 is a cross-sectional view of the header of FIG. 6, taken along the line 10-10.

FIGS. 4-8 illustrate the mounting tabs 30 in a predisposed open position and FIGS. 9-10 illustrate the mounting tabs 30 in a closed position. The position of the deformation features 50 in the header 8 facilitate flexibility and bending of the mounting tabs 30 during coupling of the header 8 to the fluid reservoir 10. In a non-limiting example, the position of the deformation features 50 is selected to reduce a force $F_C$ applied to the mounting tabs 30 during coupling of the header 8 to the fluid reservoir 10. For example, the position of the deformation features 50 is selected to maximize a moment arm between the position of mounting tabs 30 where the force FC is applied during coupling of the header 8 to the fluid reservoir 10 and the deformation features 50. Additionally, the deformation features 50 are positioned in a portion of the header 8 where minimal bending moment will be imposed during operation. Minimal bending moment is imposed at a point aligned with a load force $F_L$ applied to the receiving surface 36 during operation. In operation, the load force $F_L$ is substantially perpendicular to the receiving surface 36. By localizing the deformation features 50 to the above-described parameters, the force $F_C$ applied during coupling of the header 8 to the fluid reservoir 10 is minimized, and a strength and integrity of the header 8 is maintained.

For example, in the embodiments illustrated, the deformation features 50 are formed at an interface of the mounting tabs 30 and the base portion 28 directly adjacent the second coupling features 32. Each of the deformation features 50 is formed in the sidewall 40 of the reinforcement features 38 and directly adjacent the second coupling features 32. However, the deformation features 50 can be formed at any position of the header 8 as desired to facilitate bending of the mounting tabs 30 during coupling of the header 8 to the fluid reservoir 10 during assembly.

Referring to FIGS. 11-14, a continuously formed sealing element 44 is disposed in the base portion 28 of the header 8. In the illustrated embodiment the sealing element 44 is formed separately from each of the fluid reservoir 10 and header 8. Optionally, the sealing element 44 may be integrally formed with at least one of the fluid reservoir 10 and header 8. The sealing element 44 is formed of a resilient polymeric material, such as a flouroelastomer (FKM) or an ethylene propylene diene monomer (EPDM). Other suitable materials for the sealing element 44 will be appreciated by those of ordinary skill in the art. It is understood the base portion 28 does not have to include a sealing element.

It is understood, other configurations of the header 8 can be contemplated, as desired, without departing from the scope of the disclosure. In the embodiments illustrated, the header 8 is substantially rectangular shaped. However, the header can be any shape as desired and pre-formed in such manner that the mounting tabs 30 extend the entire sides of or are the entire sides of the header 8. In such an embodiment, the entire sides of the header 8 can be bent inwardly.

During assembly, the fluid reservoir 10 is secured to the header 8 of the heat exchanger 2 by inserting the base 14 of the fluid reservoir 10 into the base portion 28 of the header 8.

Figure 11:
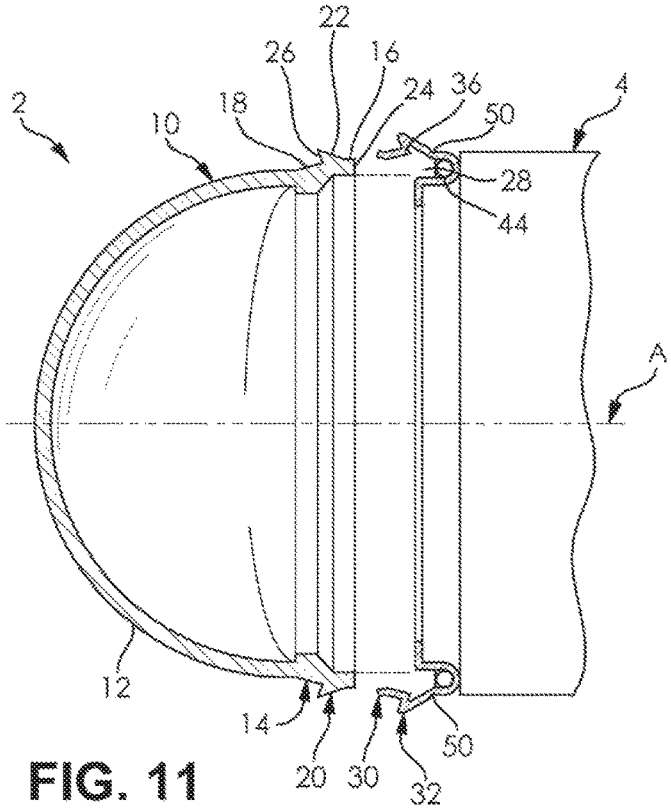
FIG. 11 is a fragmentary schematic cross-sectional elevation view of the assembly of FIG. 1, wherein the cross-section is taken through a coupling feature of the heat exchanger and the assembly is in a disassembled state.

In a first step, shown in FIG. 11 the fluid reservoir 10 is aligned with the header 8, wherein the base 14 of the sidewall 12 is aligned with the base portion 28 of the header 8 in a direction along the axis (A). The mounting tabs 30 are predisposed in the open position with respect to the axis (A). In the open position, the mounting tabs 30 are spread apart from each other such that the base 14 of the fluid reservoir 10 can be received between the mounting tabs 30 unobstructed. It is understood, the mounting tabs 30 can be predisposed at an intermediate position (not shown) with respect to the axis (A). In the intermediate position, the mounting tabs 30 are formed in a partially opened position, wherein the lip 16 of the base 14 can be received inside of the mounting tabs 30, and wherein the distal ends 22 of the first coupling features 20 are formed at least partially outside of the mounting tabs 30.

Although the mounting tabs 30 of the instant disclosure are predisposed in the open position or the intermediate position during stamping or forming of the header 8, it will be appreciated that the mounting tabs 30 may be actively bent to the open position or the intermediate position immediately prior to or during assembly of the heat exchanger 2.

Figure 12:
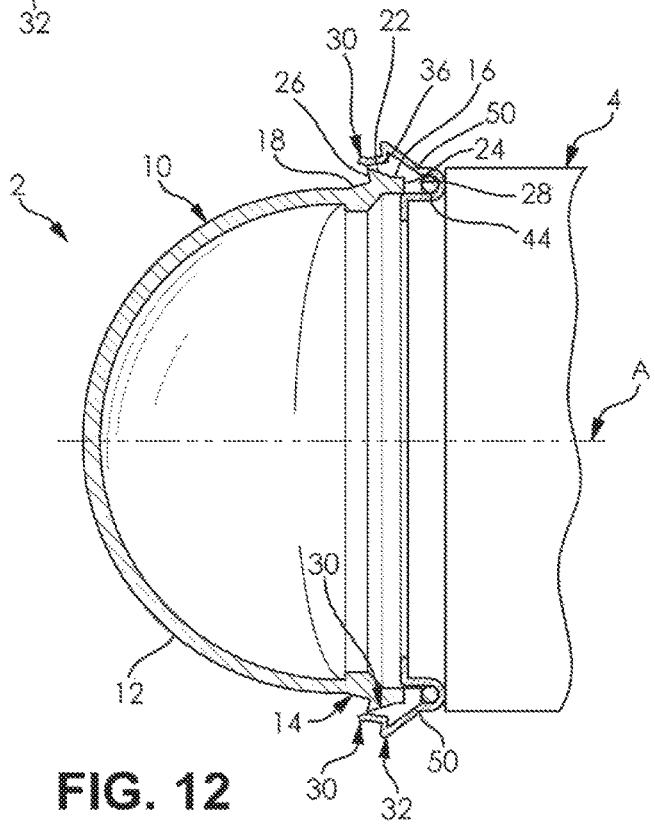
FIG. 12 is a fragmentary schematic cross-sectional elevation view of the assembly of FIG. 1, wherein the cross-section is taken through a coupling feature of the heat exchanger and the assembly is in a partially assembled state.
Figure 13:
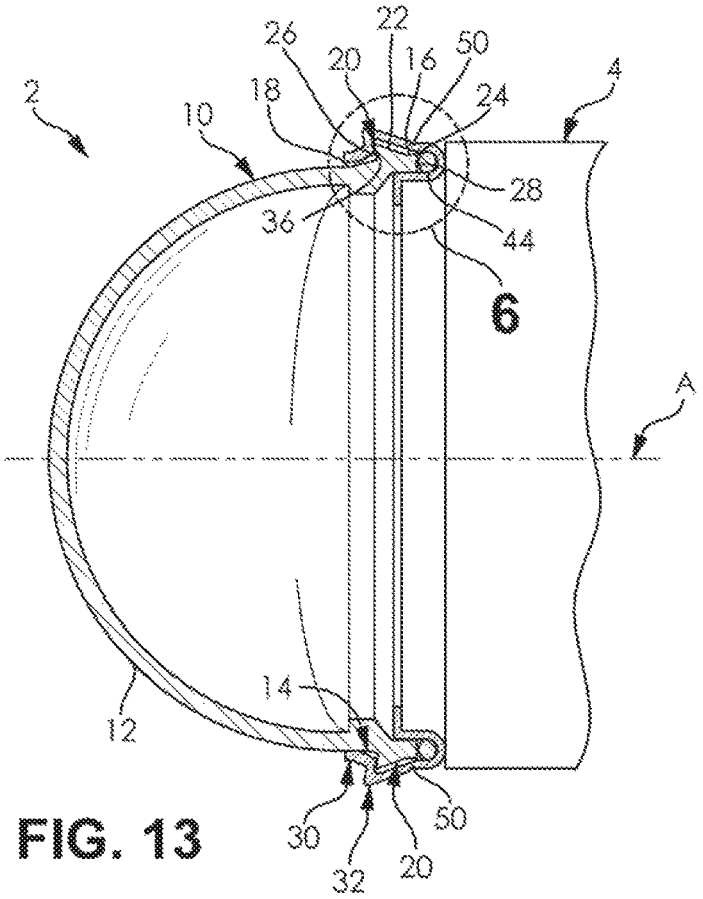
FIG. 13 is a fragmentary schematic cross-sectional elevation view of the assembly of FIG. 1, wherein the cross-section is taken through a coupling feature of the heat exchanger and the assembly is in an assembled state.
Figure 14:
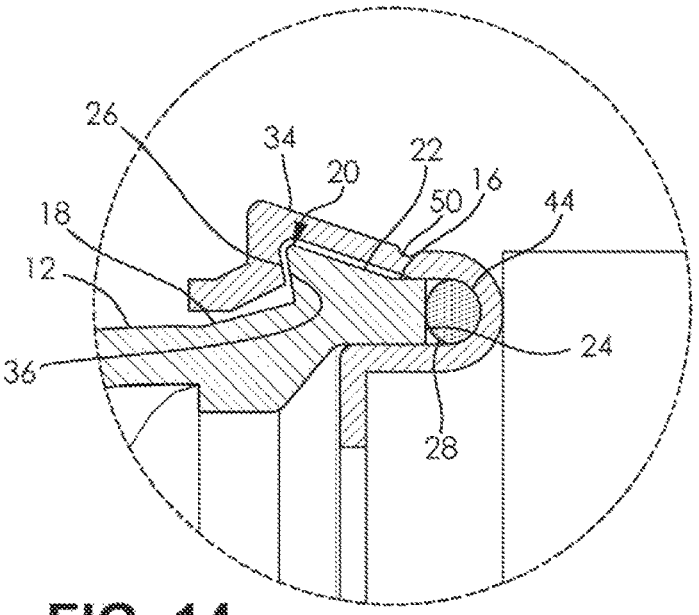
FIG. 14 is an enlarged fragmentary schematic cross-sectional elevation view of the assembly of FIG. 13, taken at area 14.

In a second step, shown in FIG. 12 the fluid reservoir 10 is advanced into the header 8, wherein the base 14 of the fluid reservoir 10 passes through the mounting tabs 30 of the header 8. As the lip 16 of the fluid reservoir 10 is received in the base portion 28, the sealing element 44 is compressed by the terminal end 24 of the lip 16 to form a fluid seal between the fluid reservoir 10 and the header 8, as shown in FIGS. 13-14. With the sealing element 44 compressed in the base portion 28, the first coupling features 20 are aligned with the second coupling features 32, and the mounting tabs 30 are bent inwards, wherein the first coupling features 20 of the fluid reservoir 10 are received in the second coupling features 32 of the header 8.

The mounting tabs 30 are bent inwards towards the fluid reservoir 10, from the open position to the closed position, by applying the force $F_C$ to the mounting tabs 30 to couple the header 8 to the fluid reservoir 10. The mounting tabs 30 are bent about a pivot point proximate to the deformation features 50. It is understood proximate to mean at, nearly accurate, almost, or next to but very near. In one exemplary embodiment, the mounting tabs 30 can be bent inwardly by an elastic force of the mounting tabs 30 when the base 14 is positioned within the base portion 28. In another exemplary embodiment, the mounting tabs 30 can be manually bent inwards during an assembly process such as crimping, welding, brazing, laser forming, or similar processes. It will be understood that a combination of the elastic force and manual bending may be utilized to move the mounting tabs 30 to the closed position. As the force $F_C$ is applied to the mounting tabs 30, the deformation features 50 minimize an amount of the force $F_C$ required to bend the mounting tabs 30 without affecting the rigidity and integrity of the mounting tabs 30 during operation. It is understood, the deformation features 50 can be formed prior to assembly or during assembly of the heat exchanger 2.

In the closed position, the engaging surfaces 26 of the first coupling features 20 cooperate with the receiving surfaces 36 of the second coupling features 32 to secure the base 14 of the fluid reservoir 10 to the base portion 28 of the header 8, and to maintain the compressive force on the sealing element 44. Accordingly, the first coupling feature 20 is compressed against the second coupling feature 32. When each of the engaging surfaces 26 and each of the receiving surfaces 36 are inclined, the compressive force causes the receiving surfaces 36 of the second coupling features 32 to be biased inward by the engaging surfaces 26 of the first coupling features 20, further securing the fluid reservoir 10 by preventing the mounting tab 30 from bending outward.

The deformation features 50 formed in the header 8 according to the disclosure facilitate bending the mounting tabs 30 during coupling of the header 8 to the fluid reservoir 10 without reducing a strength and rigidity of the header 8 or fluid reservoir 10. The deformation features 50 predetermine and sufficiently control the bending of the mounting tabs 30. With the deformation features 50, a desired thickness and a desired material of the header 8 can be maintained to militate against damage during operation, while still permitting the mounting tabs 30 to be bent with less force. Particularly, undesired stress concentrations, deformations, and distortions are limited in the header 8 according the present disclosure.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A header for a heat exchanger comprising:

a header frame defining an opening and including a base portion circumscribing a perimeter thereof, a mounting tab extending from the base portion, and an outer surface, the mounting tab configured to bend inwardly with respect to the header frame, wherein a plurality of coupling features is formed on the mounting tab and extends outwardly from the mounting tab, each of the coupling features is an enclosed cavity, the cavity is defined by a sidewall extending laterally outwardly from the mounting tab and an end wall extending between the sidewall and the base portion, the sidewall of the cavity defines a receiving surface facing the base portion, and wherein the receiving surface is disposed at an angle with respect to an inner surface of the end wall; and a deformation feature formed on the header frame and configured to facilitate bending of the mounting tab, wherein the deformation feature is formed at an interface of the mounting tab and the base portion.

2. The header of claim 1, wherein the deformation feature is an indentation.

3. The header of claim 1, wherein the deformation feature is formed in one of an inner surface and the outer surface of the header frame and is a continuous elongate indentation extending along a length of the mounting tab.

4. The header of claim 1, wherein the deformation feature has an arcuate cross-sectional profile.

5. The header of claim 1, wherein the mounting tab is configured to pivot from an open position to a closed position about a pivot point proximate the deformation feature, and wherein the mounting tab is configured to be biased outwardly at an angle with respect to the base portion in the open position.

6. The header of claim 1, wherein the deformation feature is formed adjacent the coupling features.

7. The header of claim 1, wherein the deformation feature is aligned with a direction substantially perpendicular to the receiving surface.

8. The header of claim 1, wherein the base portion is recessed.

9. The header of claim 1, wherein the deformation feature is a coined deformation feature.

10. A heat exchanger for a motor vehicle, the heat exchanger comprising:

a fluid reservoir having a base;

a header receiving the base of the fluid reservoir for coupling thereto, the header having a base portion and a mounting tab extending from the base portion, the mounting tab configured to bend inwardly from an open position to a closed position, the mounting tab engaging the fluid reservoir in the closed position, wherein a plurality of coupling features is formed on the mounting tab and extends outwardly from the mounting tab, each of the coupling features of the mounting tab is an enclosed cavity, the cavity is defined by a sidewall extending laterally outwardly from the mounting tab and an end wall extending between the sidewall and the base portion, the sidewall of the cavity defines a receiving surface facing the base portion, wherein the receiving surface is disposed at an angle with respect to an inner surface of the end wall, and wherein the mounting tabs include a reinforcement feature, the reinforcement feature having a sidewall extending from the base portion and an inwardly formed shoulder extending from the sidewall of the reinforcement feature; and a deformation feature formed in the header, the deformation feature minimizing a force required to bend the mounting tab from the open position to the closed position, wherein the deformation feature is formed at an interface of the mounting tab and the base portion.

11. The heat exchanger of claim 10, wherein the deformation feature is formed in one of an inner surface and an outer surface of the header.

12. The heat exchanger of claim 10, wherein the deformation feature is an indentation.

13. The heat exchanger of claim 10, wherein the base portion of the header is configured to receive the base of the fluid reservoir.

14. The heat exchanger of claim 10, wherein the fluid reservoir includes a plurality of coupling features configured to engage the coupling features of the mounting tab.

15. The heat exchanger of claim 14, wherein the deformation feature is formed adjacent the coupling features of the mounting tab.

16. The heat exchanger of claim 14, wherein each of the coupling features of the fluid reservoir includes an engaging surface configured to cooperate with the receiving surface to secure the fluid reservoir to the header, and wherein the deformation feature is aligned with a direction substantially perpendicular to the receiving surface.

17. A method of assembling a heat exchanger, the method comprising the steps of:

providing a fluid reservoir and a header including a base portion and a mounting tab extending from the base portion, the mounting tab configured to bend from an open position to a closed position wherein a plurality of coupling features is formed on the mounting tab and extends outwardly from the mounting tab, each of the coupling features is an enclosed cavity, the cavity defined by a sidewall extending laterally outwardly from the mounting tab and an end wall extending between the sidewall and the base portion, the sidewall of the cavity defining a receiving surface facing the base portion, wherein the receiving surface is disposed at an angle with respect to an inner surface of the end wall;

forming a deformation feature on one of an inner surface and an outer surface of the header at an interface of the mounting tab and the base portion to facilitate bending of the mounting tab;

inserting a portion of the fluid reservoir into the header; and bending the mounting tab inwardly from the open position to the closed position about a pivot point proximate the deformation feature to engage the fluid reservoir.

18. The method of claim 17, wherein the step of forming the deformation feature includes forming the deformation feature by at least one of a coining process, a swaging process, and a laser process.

19. The method of claim 17, further comprising the step of crimping, welding, or brazing the header to the fluid reservoir.

* * * * *